US009976780B2

(12) United States Patent
Nakano et al.

(10) Patent No.: US 9,976,780 B2
(45) Date of Patent: May 22, 2018

(54) STIRLING-TYPE PULSE TUBE REFRIGERATOR

(71) Applicant: Sumitomo Heavy Industries, Ltd., Tokyo (JP)

(72) Inventors: Kyosuke Nakano, Tokyo (JP); Yoshikatsu Hiratsuka, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 251 days.

(21) Appl. No.: 14/728,467

(22) Filed: Jun. 2, 2015

(65) Prior Publication Data

US 2015/0354861 A1 Dec. 10, 2015

(30) Foreign Application Priority Data

Jun. 5, 2014 (JP) ..... 2014-116446

(51) Int. Cl.
*F25B 9/14* (2006.01)

(52) U.S. Cl.
CPC ..... *F25B 9/145* (2013.01); *F25B 9/14* (2013.01); *F25B 2309/001* (2013.01); *F25B 2309/1408* (2013.01); *F25B 2309/1413* (2013.01); *F25B 2309/1421* (2013.01)

(58) Field of Classification Search
CPC ..... F25J 2309/1406–2309/1409; F25B 2309/1406–2309/1409; F25B 9/14
USPC ..... 62/6
See application file for complete search history.

(56) References Cited

U.S. PATENT DOCUMENTS

2006/0144054 A1* 7/2006 Xu ..... F25B 9/10 62/6
2008/0256958 A1* 10/2008 Xu ..... F25B 9/10 62/6

FOREIGN PATENT DOCUMENTS

JP 2004-333054 A 11/2004

* cited by examiner

*Primary Examiner* — Tareq Alosh
(74) *Attorney, Agent, or Firm* — Michael Best & Friedrich LLP

(57) ABSTRACT

A Stirling-type pulse tube refrigerator includes: a regenerator that has a low temperature end and high temperature end; a pulse tube that is arranged coaxially with the regenerator, and that is connected to the regenerator so as to enable working gas to circulate therebetween; a low temperature heat exchanger that is disposed in the low temperature end of the regenerator, and that has a gas flow passage serving as a flow passage for the working gas; and a flow straightener that is disposed in an end portion, on a side close to the low temperature heat exchanger, out of end portions of the pulse tube. The gas flow passage and the flow straightener are spaced away from each other, and a length of a connecting passage connecting the gas flow passage and the flow straightener is equal to or shorter than 10% of a length of the pulse tube.

2 Claims, 7 Drawing Sheets

STIRLING-TYPE PULSE TUBE REFRIGERATOR

BACKGROUND

Technical Field

Certain embodiments of the invention relate to a pulse tube refrigerator, and particularly relate to a Stirling pulse tube refrigerator.

Description of Related Art

In order to cool superconductive magnets or detectors, a cryogenic refrigerator is used for a cryopump. This cryogenic refrigerator generally uses helium gas as working gas. Several methods are adopted for the cryogenic refrigerator, but among them, a pulse tube refrigerator is used with low vibration and highly expected reliability, since the pulse tube refrigerator has no movable component in an expander for expanding the working gas. Furthermore, a Stirling pulse tube refrigerator employs a refrigeration cycle which is based on a reversible process. Therefore, it is possible to expect high efficiency. For example, the pulse tube refrigerator described above is disclosed in the related art.

SUMMARY

According to an embodiment of the present invention, there is provided a Stirling pulse tube refrigerator which includes a regenerator that has a low temperature end and high temperature end; a pulse tube that is arranged coaxially with the regenerator, and that is connected to the regenerator so as to enable working gas to circulate therebetween; a low temperature heat exchanger that is disposed in the low temperature end of the regenerator, and that has a gas flow passage for the working gas; and a flow straightener that is disposed in an end portion on a side close to the low temperature heat exchanger, within an end portion of the pulse tube. The gas flow passage and the flow straightener are spaced away from each other, and a length of a connecting passage connecting the gas flow passage and the flow straightener is equal to or shorter than 10% of a length of the pulse tube.

DETAILED DESCRIPTION

Figure 1:
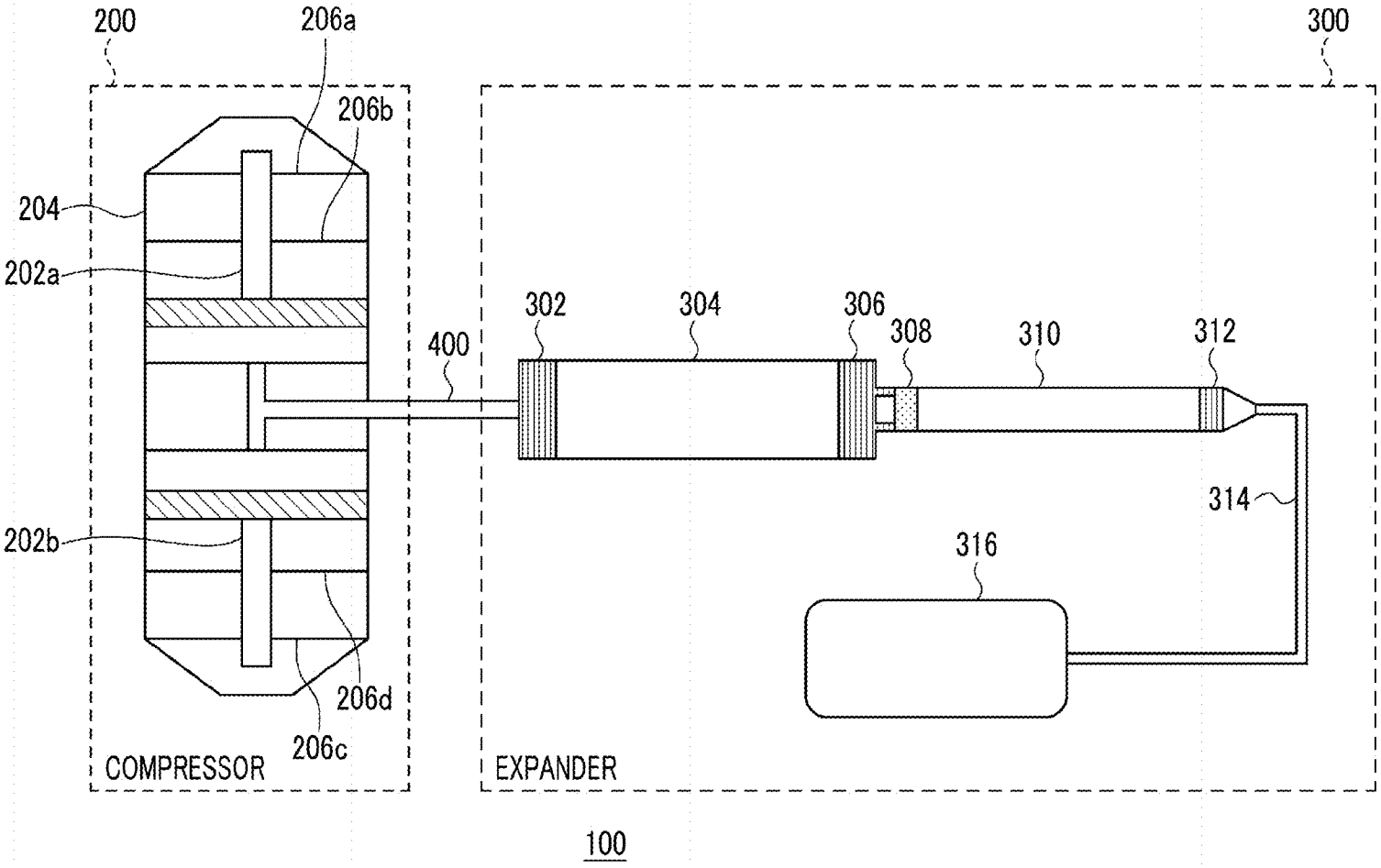
FIG. 1 is a schematic view illustrating an overall configuration of a Stirling pulse tube refrigerator according to an embodiment of the present invention.

It is desirable to provide a technique for improving the refrigerating capacity of a Stirling pulse tube refrigerator.

As an aspect of certain embodiments of the present invention, the above-described configuration elements may be arbitrarily combined with one another, and the configuration elements or expressions described herein may be replaced with one another between methods, devices, and systems.

According to an embodiment of the present invention, it is possible to improve the refrigerating capacity of a Stirling pulse tube refrigerator.

Hereinafter, an embodiment of the present invention will be described in detail with reference to the drawings. The same reference numerals are given to the same elements in the description, and repeated description thereof will be appropriately omitted. In addition, a configuration described herein is an example, and is not intended to limit the scope of certain embodiments of the present invention.

FIG. 1 is a schematic view illustrating an overall configuration of a Stirling pulse tube refrigerator 100 according to the embodiment. The Stirling pulse tube refrigerator 100 includes a compressor 200, an expander 300, and a flow passage 400 for connecting the compressor 200 and the expander 300.

The compressor 200 collects working gas returning from the expander 300 via the flow passage 400. After compressing the collected working gas, the compressor 200 supplies high pressure working gas to the expander 300 via the flow passage 400. The compressor 200 repeatedly collects, compresses, and supplies the working gas, thereby generating sinusoidal wave pressure vibrations in the working gas. An operation frequency of the compressor 200 may be approximately 50 Hz to 60 Hz which is equivalent to that of a commercial power supply. In addition, an upper limit value of the pressure amplitude of the working gas may be approximately 3 MPa, and a lower limit value thereof may be approximately 1 MPa. The compression heat generated by compressing the working gas may heat the compressor 200. Accordingly, the compressor 200 may be cooled by a water cooling-type cooling mechanism (not illustrated).

In an example illustrated in FIG. 1, the compressor 200 is a two-cylinder opposed pressure vibration generating mechanism, and includes a first piston 202*a* and a second piston 202*b*. Both the first piston 202*a* and the second piston 202*b* are accommodated in a cylinder 204. The cylinder 204 further accommodates a first flexure bearing 206*a*, a second flexure bearing 206*b*, a third flexure bearing 206*c*, and a fourth flexure bearing 206*d*.

The first flexure bearing 206*a* and the second flexure bearing 206*b* are connected to the first piston 202*a*, and support the first piston 202*a* so as to reciprocate freely. Similarly, the third flexure bearing 206*c* and the fourth flexure bearing 206*d* are connected to the second piston 202*b*, and support the second piston 202*b* so as to reciprocate.

The flexure bearings have properties in which the flexure bearing has high stiffness in an axial direction of the connected piston and has low stiffness in a radial direction thereof. Accordingly, when reciprocating in the axial direction inside the cylinder 204, the first piston 202*a* and the second piston 202*b* can be prevented from coming into contact with an inner wall of the cylinder 204. The compressor 200 is configured so as to be airtight except for the flow passage 400 serving as an inlet and an outlet of the working gas.

The expander 300 includes an aftercooler 302, a regenerator 304, a low temperature heat exchanger 306, a flow straightener 308, a pulse tube 310, a high temperature heat exchanger 312, an inertance-tube 314, and a buffer tank 316. These elements are connected sequentially in the above-described order.

An end of the aftercooler 302 is connected to an end portion of the flow passage 400. The aftercooler 302 may be a water cooling-type heat exchanger, for example. The aftercooler 302 cools the working gas supplied from the compressor 200, and realizes heat exchange for radiating the heat outward from the expander 300. The other end of the aftercooler 302 is connected to a high temperature end of the regenerator 304.

The regenerator 304 has the high temperature end and a low temperature end. The regenerator 304 has a cylindrical outer peripheral surface. A cold storage material (not illustrated) in which several types of metal mesh are stacked on one another is accommodated inside the regenerator 304. The cold storage material cools the working gas supplied by the compressor 200. In addition, the cold storage material stores cold of the working gas returning from the pulse tube 310. The low temperature heat exchanger 306 is disposed in the low temperature end of the regenerator 304.

The low temperature heat exchanger 306 may be made of a material having high heat conductivity, for example, such as copper, and has a gas flow passage serving as a flow passage of the working gas. The low temperature heat exchanger 306 is cooled by the working gas, when the expanded working gas whose temperature is lowered passes through the gas flow passage. The gas flow passage included in the low temperature heat exchanger 306 will be described in detail later. A cooling stage (not illustrated) which is thermally connected to a cooling object is arranged in the low temperature heat exchanger 306. Although there is no limit, the low temperature heat exchanger 306 comes to have a temperature of approximately 77 K during the operation of the Stirling pulse tube refrigerator 100.

The flow straightener 308 is disposed in a low temperature end which is an end portion, on aside close to the low temperature heat exchanger 306, out of end portions of the pulse tube 310. The flow straightener 308 is configured so that multiple meshes are stacked in multiple layers. The flow straightener 308 is also called a strainer, and reduces vortex flow, swirling flow, or turbulence in the flow velocity distribution of the working gas which flows out from the pulse tube 310 and flows into the low temperature heat exchanger 306. The flow straightener 308 allows the uniform flow of the working gas flowing into the low temperature heat exchanger 306. Accordingly, it is possible to improve the heat exchange efficiency of the low temperature heat exchanger 306.

In the Stirling pulse tube refrigerator 100 according to the embodiment, a configuration is adopted in which the flow straightener 308 and an outlet of the gas flow passage disposed in the low temperature heat exchanger 306 are separated from each other so as to circulate the working gas therebetween. A distance between the gas flow passage and the flow straightener 308 will described in detail later.

The pulse tube 310 is connected to the regenerator 304 so as to enable the working gas to circulate therebetween. The pulse tube 310 also has a cylindrical outer peripheral surface, similarly to the regenerator 304, and includes a low temperature end and a high temperature end. In an example illustrated in FIG. 1, the pulse tube 310 is disposed in a so-called in-line type of the Stirling pulse tube refrigerator in which the pulse tube 310 is disposed linearly side by side with the regenerator 304, outside the regenerator 304. Therefore, the regenerator 304 and the pulse tube 310 are arranged coaxially with each other, or so as to become substantially coaxial with each other. In addition, a diameter of a cross section perpendicular to an axis of the pulse tube 310 is equal to or shorter than a diameter of a cross section perpendicular to an axis of the regenerator 304.

As an example, the diameter of the cross section of the regenerator 304 according to the embodiment may be 90 mm, and the diameter of the cross section of the pulse tube 310 may be 40 mm. In addition, in order to prevent radiant heat from being transferred from the outside of the Stirling pulse tube refrigerator 100, or in order to prevent heat from being transferred due to the convection flow of the working gas, a section from the regenerator 304 to the pulse tube 310 is accommodated in a vacuum vessel (not illustrated).

The high temperature heat exchanger 312 is arranged to the high temperature end of the pulse tube 310. Although not illustrated, the high temperature heat exchanger 312 cools the working gas by using cooling water having a constant temperature, similarly to the compressor 200 and the aftercooler 302. As an example, the high temperature heat exchanger 312 comes to have a temperature of approximately 300 K during the operation of the Stirling pulse tube refrigerator 100.

The inertance-tube 314 connects the high temperature end of the pulse tube 310 and the buffer tank 316 to each other. The inertance-tube 314 is an elongated tube, and functions as a phase adjusting mechanism of the Stirling pulse tube refrigerator 100 according to the embodiment. For example, an inner diameter of the inertance-tube 314 may be 11 mm, and a length thereof may be 1,800 mm.

The buffer tank 316 is a container for storing the working gas. The buffer tank 316 stores the working gas to such an extent as to absorb pressure vibrations of the working gas flowing into and flowing out from the buffer tank 316 via the inertance-tube 314. For example, an internal volume of the buffer tank 316 may be 3.5 liters.

Pressure of the working gas stored in the buffer tank 316 is maintained to be a substantially average pressure of the Stirling pulse tube refrigerator 100. Here, the "average pressure of the Stirling pulse tube refrigerator 100" means an average value of pressure vibrations of the working gas which are generated by the compressor 200, and may be set to approximately 2 MPa, for example.

An operation principle in which the Stirling pulse tube refrigerator 100 according to the above-described configuration generates the cold is as follows. The compressor 200 supplies the working gas accompanied by sinusoidal pressure vibrations to an internal space formed from the regenerator 304 to the inertance-tube 314. The working gas supplied from the compressor 200 is cooled by the aftercooler 302, and thereafter is further cooled by a cold storage material inside the regenerator 304. When the working gas which reaches the inertance-tube 314 via the pulse tube 310 flows into the inertance-tube 314 and the buffer tank 316, a phase difference occurs between a pressure change and a flow rate change.

For this reason, a phase difference also occurs between pressure and a flow rate of the working gas inside the pulse tube 310. As a result, the working gas expands inside the pulse tube 310. Expansion of the working gas causes PV work in the low temperature end of the pulse tube 310, thereby generating the cold in the low temperature end. The cooled working gas is straightened by the flow straightener 308, and thereafter passes through the low temperature heat exchanger 306 so as to cool the low temperature heat exchanger 306. After passing through the low temperature heat exchanger 306, the working gas cools the cold storage material inside the regenerator 304, and returns to the compressor 200.

The above-described operation is repeatedly performed, thereby enabling the Stirling pulse tube refrigerator 100 according to the embodiment to generate the cold having a temperature of approximately 77 K.

Next, a distance between the gas flow passage disposed in the low temperature heat exchanger 306 and the flow straightener 308 will be described.

Figure 2:
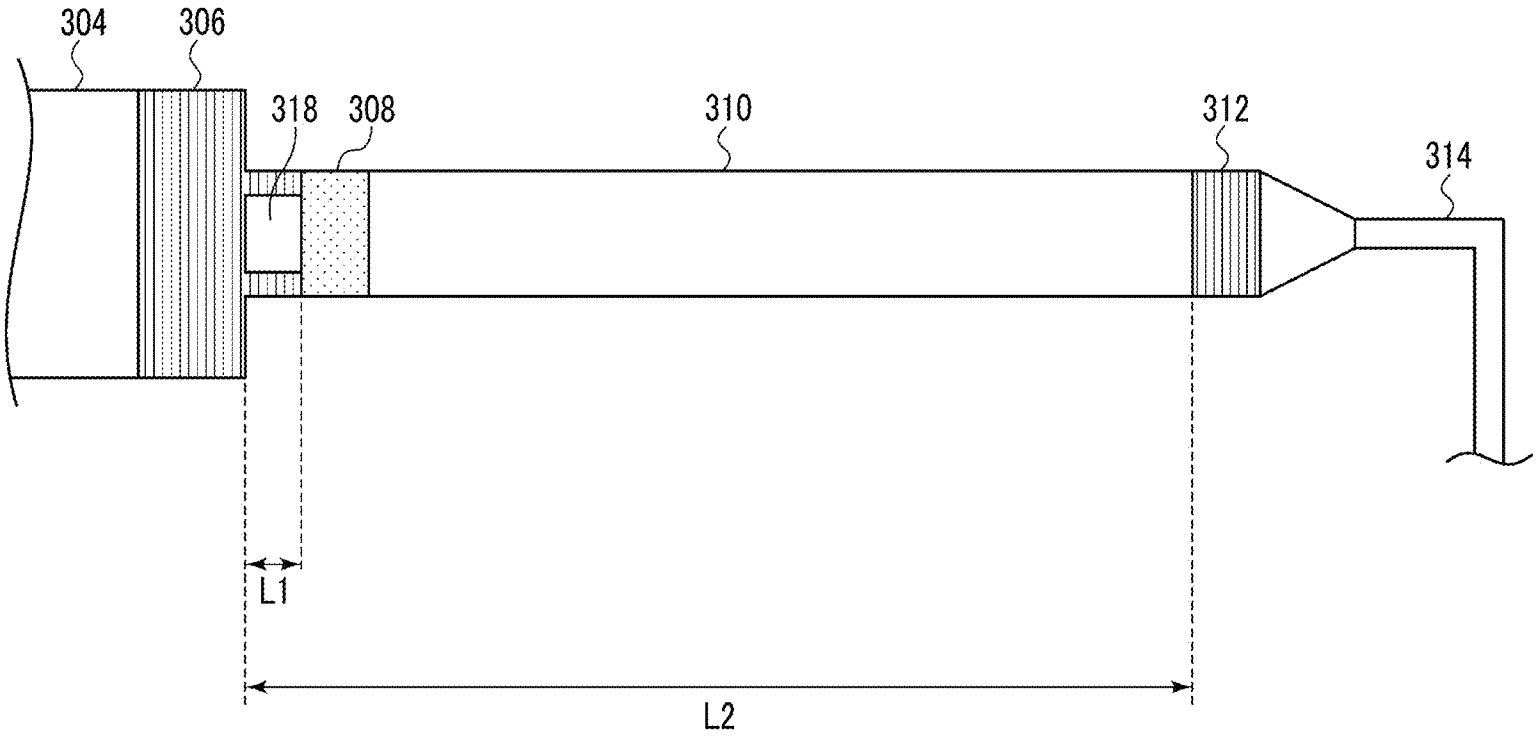
FIG. 2 is a schematic view illustrating a connection relationship among a low temperature heat exchanger, a flow straightener, and a pulse tube according to the embodiment.

FIG. 2 is a schematic view illustrating a connection relationship among the low temperature heat exchanger 306, the flow straightener 308, and the pulse tube 310 according to the embodiment of the present invention. As described above, a gas flow passage serving as a flow passage of the working gas which connects the regenerator 304 and the pulse tube 310 to each other is disposed in the low temperature heat exchanger 306. As illustrated in FIG. 2, opening portions on the pulse tube 310 side which serve as an inlet and an outlet of the gas flow passage are spaced away from the flow straightener 308. Therefore, a flow passage (channel) 318 of the working gas which connects the gas flow passage and the flow straightener 308 to each other is present between the gas flow passage and the flow straightener 308.

As illustrated in FIG. 2, a length of the connecting passage 318 is set to L1, and a length of the pulse tube 310 is set to L2. Here, the "length of the pulse tube 310" means a distance between the low temperature end (that is, a cooling stage (not illustrated)) of the pulse tube 310 and the low temperature side (that is, an inner wall surface of a vacuum vessel (not illustrated)) of the high temperature heat exchanger 312, for example.

For example, the length L2 of the pulse tube 310 according to the embodiment may be 250 mm. In addition, the length L1 of the channel 318 may be 1 mm. In this case, the length L1 of the flow passage 318 with respect to the length L2 of the pulse tube 310 may be expressed by 1/250×100=0.4%.

The present inventors measured refrigerating capacity of the Stirling pulse tube refrigerator 100 through experiments in a case of L1=0 mm, that is, in a case where the connecting passage 318 disposed in the low temperature heat exchanger 306 is brought into contact with the flow straightener 308, and in a case of L1=1 mm, that is, in a case where both of these are spaced away from each other. According to the experiments, when input power of the compressor 200 is set to 2.5 kW, it was observed that the refrigerating capacity which was 27 W in the temperature of 77 K in the case of L1=0 mm is changed to 43.5 W by setting L1=1 mm. These experiments enable the present inventors to confirm that if the connecting passage 318 and the flow straightener 308 are spaced away from each other by 1 mm, the refrigerating capacity of the Stirling pulse tube refrigerator 100 increased approximately 1.6 times (43.5 W/27 W) as compared to a case where both of these are not spaced away from each other.

Figure 3:
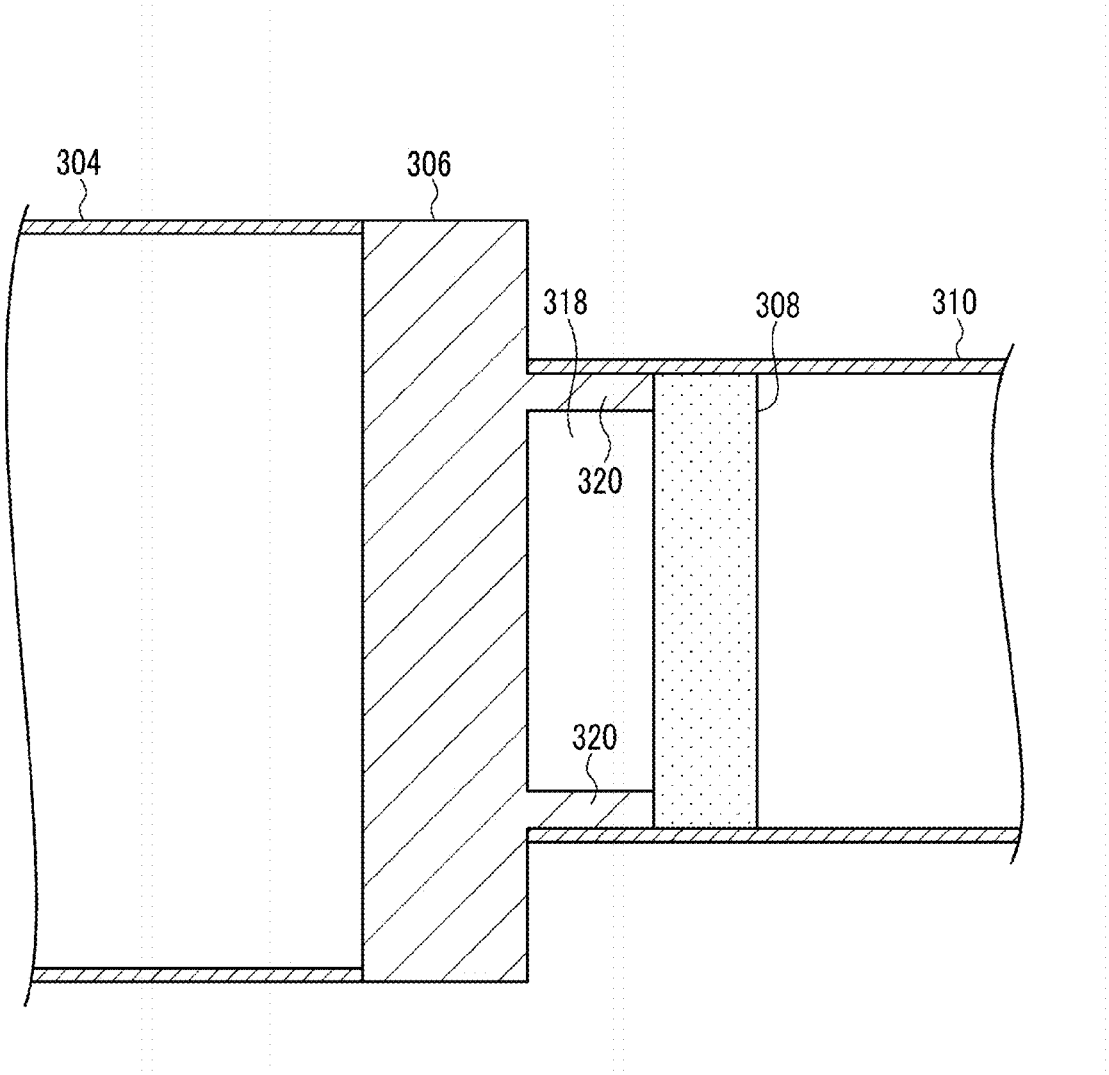
FIG. 3 is an enlarged view schematically illustrating a cross-section of the low temperature heat exchanger according to the embodiment.

FIG. 3 is an enlarged view schematically illustrating a cross-section of the low temperature heat exchanger 306 according to the embodiment. As illustrated in FIG. 3, the low temperature heat exchanger 306 is formed so as to protrude in the axial direction of the pulse tube 310, and has a convex portion 320 inserted to the pulse tube 310. Since the pulse tube 310 has a cylindrical shape, the convex portion 320 is also formed in an annular shape.

The convex portion 320 comes into contact with the flow straightener 308 inside the pulse tube 310 so as to support the flow straightener 308. This generates a space between the low temperature heat exchanger 306 and the flow straightener 308, thereby causing the space to serve as the connecting passage 318.

Subsequently, a shape of the flow passage of refrigerant gas which is also received by the low temperature heat exchanger 306 will be described.

Figure 4:
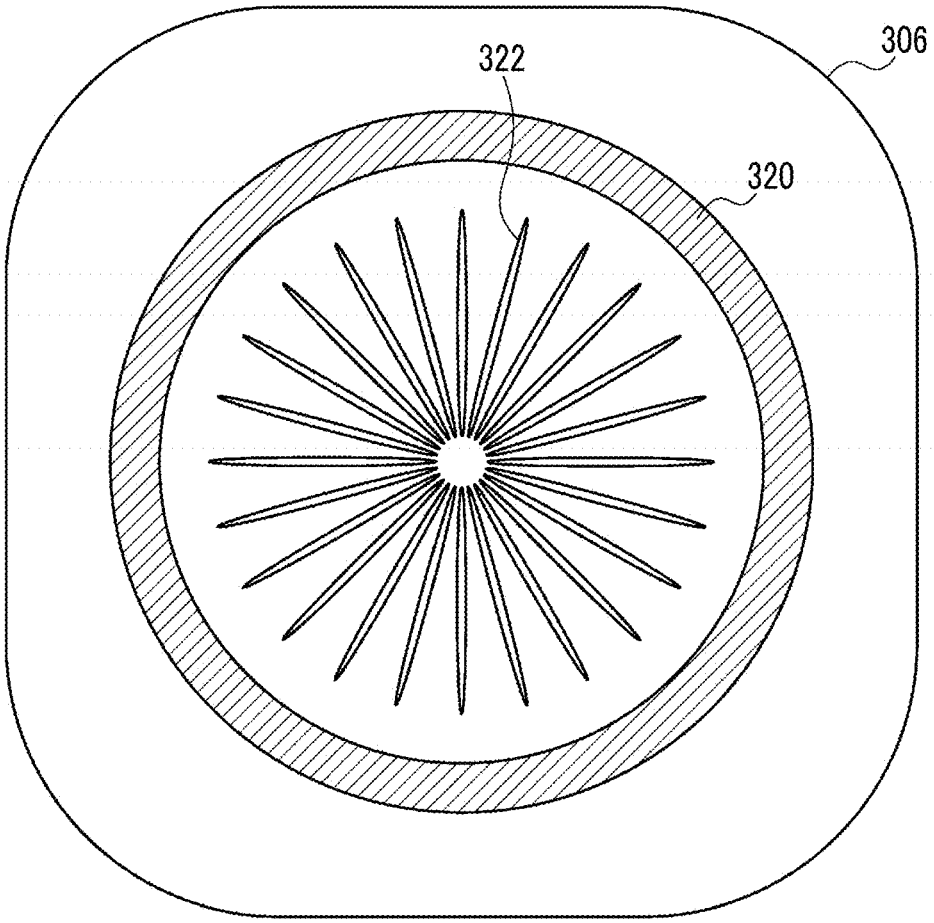
FIG. 4 is a schematic view illustrating an example of an external appearance when the low temperature heat exchanger according to the embodiment is viewed from a low temperature end side of the pulse tube.

FIG. 4 is a schematic view illustrating an example of an external appearance when the low temperature heat exchanger 306 according to the embodiment is viewed from the low temperature end side of the pulse tube 310. As described above, the low temperature heat exchanger 306 has the convex portion 320 disposed in an annular shape. Opening portions serving as an inlet and an outlet of a gas flow passage 322 are disposed in a region surrounded by the convex portion 320 within a surface of the low temperature heat exchanger 306.

In an example of the low temperature heat exchanger 306 illustrated in FIG. 4, the gas flow passage 322 is configured to include multiple radially formed slits. Therefore, as illustrated in FIG. 4, the opening portions serving as the inlet and the outlet of the gas flow passage 322 are also radially and uniformly formed side by side on the surface of the low temperature heat exchanger 306. This allows the working gas to uniformly flow inside the low temperature heat exchanger 306. As a result, heat exchange efficiency of the low temperature heat exchanger 306 increases. The shape of the gas flow passage 322 is not limited to each shape of the multiple radially formed slits.

Figure 5:
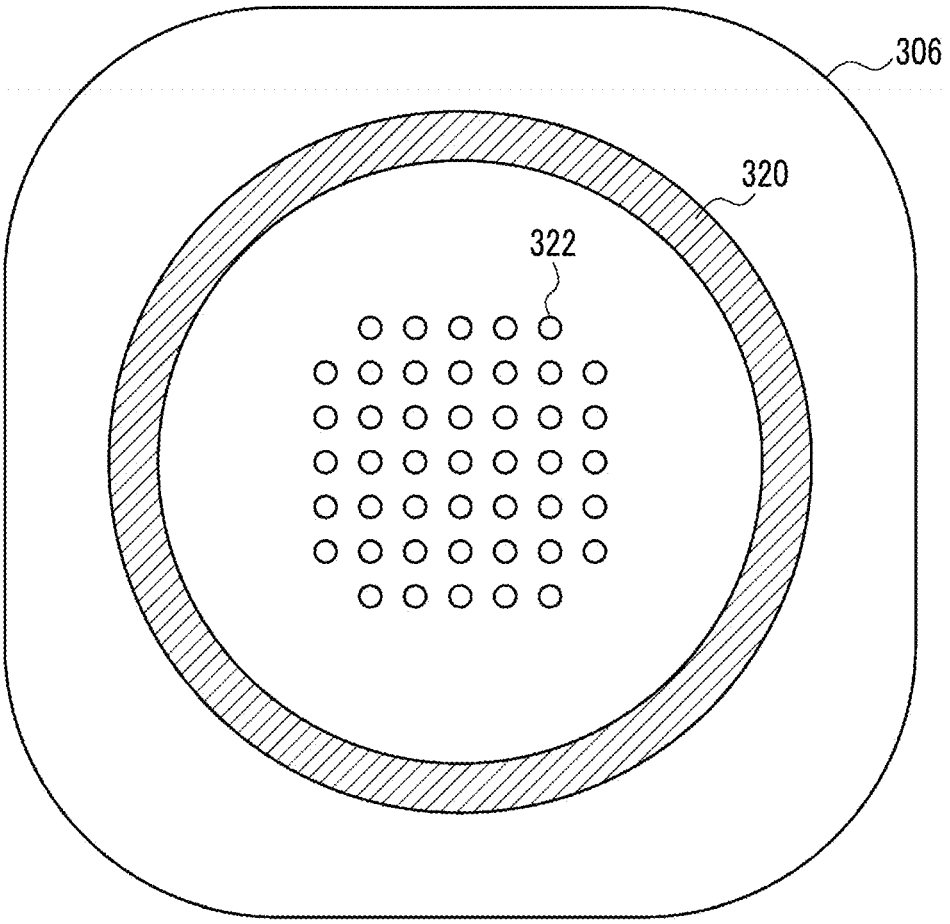
FIG. 5 is a schematic view illustrating another example of an external appearance when the low temperature heat exchanger according to the embodiment is viewed from the low temperature end side of the pulse tube.

FIG. 5 is a schematic view illustrating another example of an external appearance when the low temperature heat exchanger 306 according to the embodiment is viewed from the low temperature end side of the pulse tube 310. In the example of the low temperature heat exchanger 306 illustrated in FIG. 5, the gas flow passage 322 is configured to include multiple through-holes disposed in a grid shape. Therefore, as illustrated in FIG. 5, opening portions serving as an inlet and an outlet of the gas flow passage 322 are uniformly formed side by side in a grid shape on the surface of the low temperature heat exchanger 306. Similarly to a case of the low temperature heat exchanger 306 illustrated in FIG. 4, this configuration allows the working gas to uniformly flow inside the low temperature heat exchanger 306, thereby increasing heat exchange efficiency of the low temperature heat exchanger 306.

As described above, the gas flow passage 322 disposed in the low temperature heat exchanger 306 may adopt any configuration as long as the working gas uniformly flows inside the low temperature heat exchanger 306. Accordingly, the configuration is not limited to the shape of the multiple radially formed slits or the shape of the multiple through-holes formed in a grid shape.

As described above, the opening portions serving as the inlet and the outlet of the gas flow passage 322 are disposed on the surface of the low temperature heat exchanger 306. Therefore, if the low temperature heat exchanger 306 and the flow straightener 308 are brought into contact with each other, there is a possibility that meshes configuring the flow straightener 308 may close some opening portions among the multiple opening portions of the gas flow pas sage 322. If the flow straightener 308 closes some opening portions, the working gas does not flow uniformly inside the low temperature heat exchanger 306, thereby causing a possibility that the heat exchange efficiency may decrease. Therefore, it is preferable to separate the inlet and the outlet of the gas flow passage 322 and the flow straightener 308 from each other. As described above, in the Stirling pulse tube refrigerator 100 according to the embodiment, the distance between the inlet and the outlet of the gas flow passage 322 and the flow straightener 308 (that is, the length L1 of the connecting passage 318) is far from each other by 0.4% of the length L2 of the pulse tube 310.

On the other hand, if the length L1 of the connecting passage 318 is lengthened, the connecting passage 318 is caused to have a so-called dead volume, thereby causing a possibility of decreasing the refrigerating capacity of the Stirling pulse tube refrigerator 100. Therefore, it is not necessarily preferable to significantly increase the length L1 of the connecting passage 318.

The present inventors consider that setting the length L1 of the connecting passage 318 to at least approximately 10% of the length L2 of the pulse tube 310 (approximately 20 mm to 30 mm) contributes to improved refrigerating capacity of the Stirling pulse tube refrigerator 100. In view of the above-described circumstance, it is preferable to set the length L1 of the connecting passage 318 to approximately 10% or smaller of the length L2 of the pulse tube 310, and more preferably 5% or smaller.

As described above, it is possible to improve the refrigerating capacity of the Stirling pulse tube refrigerator 100 by separating the gas flow passage 322 and the flow straightener 308 from each other.

Hitherto, the embodiment of the present invention has been described. Without being limited to the above-described embodiment, certain embodiments of the present invention can be changed in design in various ways, and can adopt various modification examples. In addition, those skilled in the art may understand the adopted modification examples are included in the scope of the present invention.

First Modification Example

Hitherto, a case has been described where the Stirling pulse tube refrigerator 100 is a so-called in-line type of the Stirling pulse tube refrigerator in which the pulse tube 310 is disposed linearly side by side with the regenerator 304, outside the regenerator 304. However, the Stirling pulse tube refrigerator 100 is not limited to a case of the in-line type.

Figure 6:
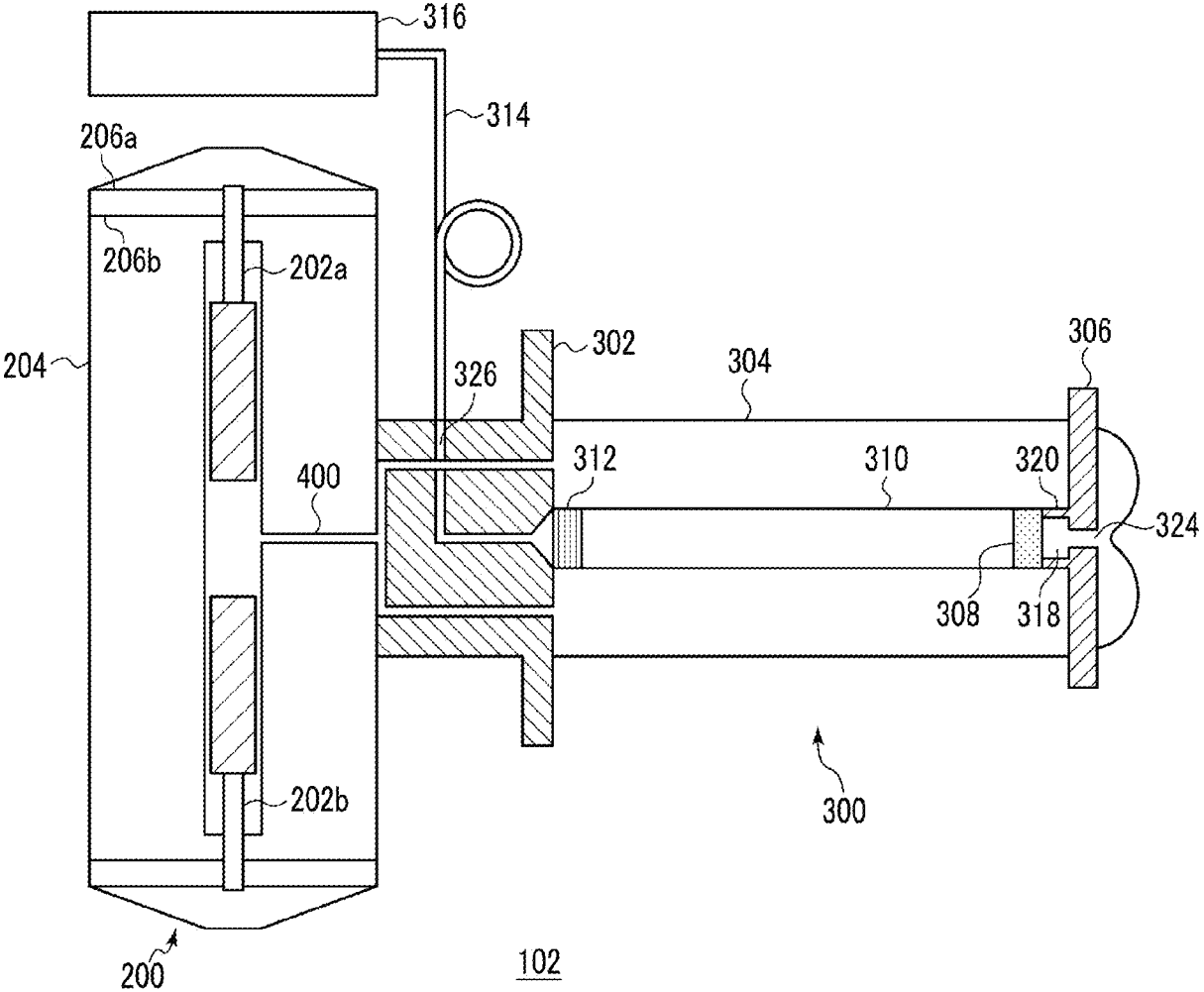
FIG. 6 is a schematic view illustrating an overall configuration of a Stirling pulse tube refrigerator according to a first modification example of the embodiment.

FIG. 6 is a schematic view illustrating an overall configuration of a Stirling pulse tube refrigerator 102 according to a first modification example of the embodiment. In FIG. 6, the same reference numerals are given to members having the same function as those in the Stirling pulse tube refrigerator 100 illustrated in FIG. 1. Hereinafter, repeated portions of the Stirling pulse tube refrigerator 100 according to the embodiment will be appropriately omitted or simplified.

An example illustrated in FIG. 6 illustrates a so-called coaxial return type of the Stirling pulse tube refrigerator 102 in which the pulse tube 310 is incorporated into the regenerator 304. Similarly to the in-line type of the Stirling pulse tube refrigerator 100, the coaxial return type of the Stirling pulse tube refrigerator 102 also includes the compressor 200, the expander 300, and the flow passage 400 which connects the compressor 200 and the expander 300 to each other.

The working gas output from the compressor 200 reaches the aftercooler 302 via the flow passage 400, and is cooled in the aftercooler 302. The working gas passing through the aftercooler 302 flows into the high temperature end of the regenerator 304.

In the coaxial return type of the Stirling pulse tube refrigerator 102, the regenerator 304 also has a cylindrical outer peripheral portion, and internally stores a cold storage material. However, the regenerator 304 in the coaxial return type of the Stirling pulse tube refrigerator 102 is different from the regenerator 304 in the in-line type of the Stirling pulse tube refrigerator 100, and also internally stores the pulse tube 310.

Here, the pulse tube 310 is arranged coaxially with the regenerator 304 or so as to become substantially coaxial with the regenerator 304. If the working gas flowing from the high temperature end of the regenerator 304 passes through the low temperature heat exchanger 306 connected to the low temperature end of the regenerator 304, the working gas returns to and reaches the flow straightener 308 disposed in the low temperature end of the pulse tube 310.

As illustrated in FIG. 6, the low temperature heat exchanger 306 in the coaxial return type of the Stirling pulse tube refrigerator 102 is also formed so as to protrude in the axial direction of the pulse tube 310, and has the convex portion 320 inserted into the pulse tube 310. Since the pulse tube 310 has a cylindrical shape, the convex portion 320 is also formed in an annular shape. The convex portion 320 supports the flow straightener 308, and the connecting passage 318 is formed between the flow straightener 308 and the low temperature heat exchanger 306. This separates the flow straightener 308 and the low temperature heat exchanger 306 from each other.

The low temperature heat exchanger 306 in the coaxial return type of the Stirling pulse tube refrigerator 102 is different from the low temperature heat exchanger 306 in the in-line type of the Stirling pulse tube refrigerator 100, and has a through-hole 324 disposed in a center portion thereof. The through-hole 324 serves as a flow passage for the working gas returning after passing through the low temperature heat exchanger 306 to reach the flow straightener 308. In addition, in the low temperature heat exchanger 306 in the coaxial return type of the Stirling pulse tube refrigerator 102, an opening serving as an inlet and an outlet of the gas flow passage 322 is formed outside the convex portion 320 formed in an annular shape.

Figure 7:
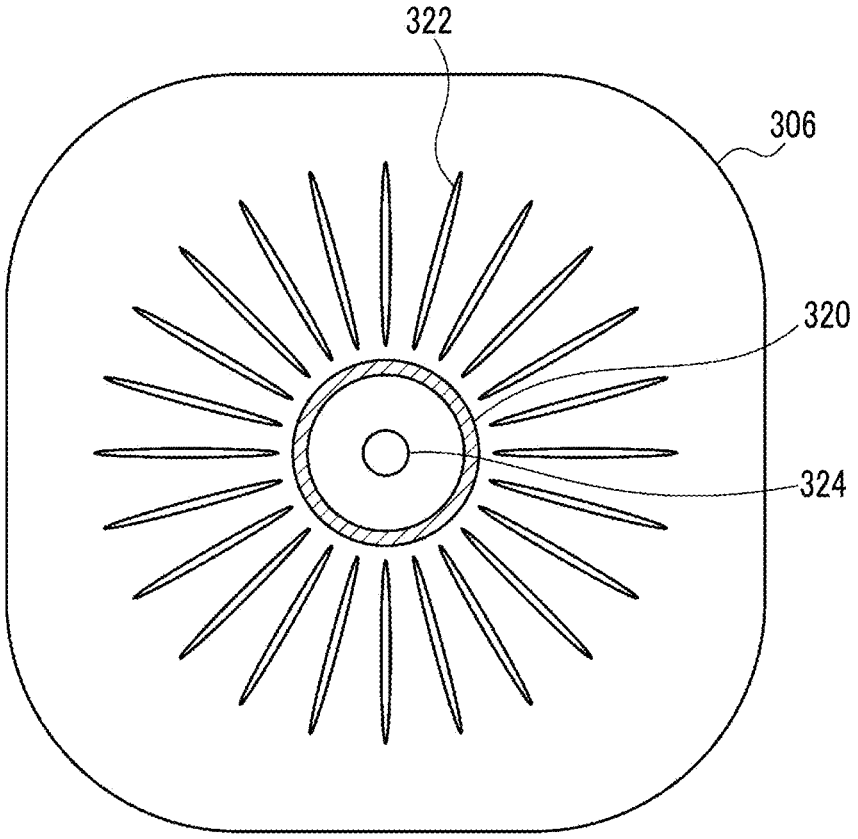
FIG. 7 is a schematic view illustrating an external appearance when the low temperature heat exchanger according to the first modification example of the embodiment is viewed from the low temperature end side of the pulse tube.

FIG. 7 is a schematic view illustrating an external appearance when the low temperature heat exchanger 306 according to the first modification example of the embodiment is viewed from the low temperature end side of the pulse tube 310. In an example illustrated in FIG. 7, the gas flow passage 322 is configured to include multiple radially formed slits. Therefore, as illustrated in FIG. 7, the opening portions serving as the inlet and the outlet of the gas flow passage 322 are also radially and uniformly formed side by side on the surface of the low temperature heat exchanger 306. This allows the working gas to uniformly flow inside the low temperature heat exchanger 306. As a result, heat exchange efficiency of the low temperature heat exchanger 306 increases.

Referring back to the description of FIG. 6, in the coaxial return type of the Stirling pulse tube refrigerator 102, the high temperature end of the regenerator 304 and the high temperature end of the pulse tube 310 are in contact with each other. Therefore, the high temperature heat exchanger 312 is in contact with the aftercooler 302. Alternatively, the high temperature heat exchanger 312 and the aftercooler 302 are realized by using the common material. In the coaxial return type of the Stirling pulse tube refrigerator 102, the high temperature heat exchanger 312 and the inertance-tube 314 are connected to each other via the flow passage 326 disposed inside the aftercooler 302. A function between the inertance-tube 314 and the buffer tank 316 is the same as a function between the inertance-tube 314 and the buffer tank 316 in the in-line type of the Stirling pulse tube refrigerator 100.

The coaxial return type of the Stirling pulse tube refrigerator 102 cools the low temperature heat exchanger 306, not only when the working gas passes through the gas flow passage 322 disposed in the low temperature heat exchanger but also when the working gas passes through the through-hole 324. Therefore, if the flow straightener 308 and the low temperature heat exchanger 306 are in contact with each other, there is a possibility that the meshes configuring the flow straightener 308 may close a portion of the through-hole 324 and may hinder the working gas from flowing. In this case, flow passage resistance of the working gas increases in the through-hole 324, thereby causing a pressure drop. Therefore, the coaxial return type of the Stirling pulse tube refrigerator 102 according to the modification example adopts a configuration in which the flow straightener 308 and the low temperature heat exchanger 306 are spaced away from each other. In this manner, as compared to a case where the flow straightener 308 and the low temperature heat exchanger 306 are in contact with each other, it is possible to improve refrigerating capacity of the coaxial return type of the Stirling pulse tube refrigerator 102.

In an example illustrated in FIG. 6, the coaxial return type of the Stirling pulse tube refrigerator 102 has been described in a case where the pulse tube 310 is accommodated inside the regenerator 304. Alternatively, the regenerator 304 may be accommodated inside the pulse tube 310. That is, any one of the pulse tube 310 and the regenerator 304 may accommodate the other one.

Second Modification Example

Hitherto, a case has been described where the low temperature heat exchanger 306 has the convex portion 320. Instead of this case, a spacer made of metal such as copper may be arranged between the low temperature heat exchanger 306 and the flow straightener 308. That is, the low temperature heat exchanger 306 may exclude the convex portion 320, and the spacer equivalent to the convex portion 320 may be inserted into the low temperature heat exchanger 306. In this manner, a configuration may be realized by separating the low temperature heat exchanger 306 and the flow straightener 308 from each other. This enables the existing low temperature heat exchanger 306 to be utilized. Accordingly, it is possible to minimize manufacturing costs of a refrigerator. In addition, it is possible to change a distance between the low temperature heat exchanger 306 and the flow straightener 308 by preparing spacers having different sizes.

Third Modification Example

Hitherto, a case has been described where the compressor 200 and the expander 300 are integrated with each other or at least both of these are arranged close to each other. The compressor 200 and the expander 300 are not necessarily arranged close to each other, and both of these may be respectively installed at spaced away locations. For example, this installation can be realized by lengthening the flow passage 400 connecting the compressor 200 and the expander 300 to each other. In this manner, a cooling object can be cooled, even when there is no space for simultaneously installing the compressor 200 and the expander 300 in a location where the cooling object is placed, if only the expander 300 can be installed therein. The reason is that the cooling object is sufficiently cooled as long as the compressor 200 is installed at a position spaced away from the cooling object.

It should be understood that the invention is not limited to the above-described embodiment, but may be modified into various forms on the basis of the spirit of the invention. Additionally, the modifications are included in the scope of the invention.

What is claimed is:

1. A Stirling pulse tube refrigerator comprising:

a regenerator that has a low temperature end and high temperature end;

a pulse tube that is arranged coaxially with the regenerator, that is connected to the regenerator so as to enable working gas to circulate therebetween, and that is accommodated by the regenerator;

a low temperature heat exchanger that is located at the low temperature end of the regenerator, the low temperature heat exchanger comprising:

an annular convex portion which is formed to protrude in an axial direction of the pulse tube, which is inserted into the pulse tube at a low temperature end of the pulse tube, and which defines a connecting passage at an inner side of the annular convex portion, and a gas flow passage for the working gas inside of the gas flow passage, wherein the gas flow passage includes a first end which opens to the regenerator and a second end which opens to the pulse tube, wherein the second end includes a through-hole at a center of the low temperature heat exchanger, wherein an inner diameter of the through-hole is smaller than an inner diameter of the connecting passage; and a flow straightener that is disposed in a low temperature end portion of the pulse tube and that is proximate to the low temperature heat exchanger, wherein the gas flow passage includes multiple slits which are formed radially, wherein the first end includes multiple openings radially arranged on a surface of the low temperature heat exchanger, wherein the multiple openings are arranged at radially outside of the annular convex portion, and wherein a length of the connecting passage is equal to or shorter than 10% of a length of the pulse tube.

2. The Stirling pulse tube refrigerator according to claim 1, wherein the convex portion supports the flow straightener.

* * * * *